US011781778B2

(12) United States Patent
Mansfield

(10) Patent No.: US 11,781,778 B2
(45) Date of Patent: Oct. 10, 2023

(54) AIR VENT REGISTER WITH IMPROVED THERMAL RESISTANCE

(71) Applicant: Matthew Mansfield, Oak Island, NC (US)

(72) Inventor: Matthew Mansfield, Oak Island, NC (US)

( * ) Notice: Subject to any disclaimer, the term of this patent is extended or adjusted under 35 U.S.C. 154(b) by 0 days.

(21) Appl. No.: 17/487,048

(22) Filed: Sep. 28, 2021

(65) Prior Publication Data

US 2022/0390143 A1 Dec. 8, 2022

Related U.S. Application Data

(60) Provisional application No. 63/086,673, filed on Oct. 2, 2020.

(51) Int. Cl.
*F24F 13/08* (2006.01)

(52) U.S. Cl.
CPC ..... *F24F 13/082* (2013.01)

(58) Field of Classification Search
CPC ..... F24F 13/022; F24F 13/0263; F24F 13/06; F24F 13/08; F24F 13/082; F24F 13/22; B29C 44/025; B29K 2995/0015
See application file for complete search history.

(56) References Cited

U.S. PATENT DOCUMENTS 2,790,376 A * 4/1957 Kennedy ..... F24F 13/08 454/331
2,959,116 A 7/1958 O'Day et al.
3,306,178 A * 2/1967 Marino ..... F24F 13/075 454/315
3,814,001 A 6/1974 Hill
5,472,380 A 12/1995 Sarazen, Jr. et al.
(Continued)

FOREIGN PATENT DOCUMENTS

CA 2298758 8/2001
CA 2298758 A1 * 8/2001 ..... F24F 13/06
JP 0367949 A 3/1991
(Continued)

OTHER PUBLICATIONS

EPS Moulded Foam used for HVAC Thermal Ducting is proven to be Energy Efficient, Mar. 29, 2018, Engineering Foam Products https://www.engineeredfoamproducts.com/news/eps-moulded-foam-used-for-hvac-thermal-ducting-is-proven-to-be-energy-efficient/ (Year: 2018).*

(Continued)

*Primary Examiner* — Edelmira Bosques
*Assistant Examiner* — Michael James Giordano
(74) *Attorney, Agent, or Firm* — Ashley D. Johnson; Dogwood Patent and Trademark Law

(57) ABSTRACT

The presently disclosed subject matter is directed to a vent register for use with an HVAC system. The register is defined by a housing comprising top and bottom plates that are permanently joined to create an interior compartment. The interior compartment imparts an insulative quality to the register by providing resistance to an increase or decrease in temperature, such as when cooled air is flowing through the system. The interior compartment can be hollow and filled with air, foam, or any insulative material. In use, the register prevents or reduces the incidence of condensation forming on the face of the register during use.

21 Claims, 8 Drawing Sheets

(56) References Cited

U.S. PATENT DOCUMENTS

| | | | | |
|---|---|---|---|---|
| 2008/0045137 | A1* | 2/2008 | Rosal | F24F 13/0245<br>454/292 |
| 2021/0190368 | A1* | 6/2021 | Combs | B29C 41/20 |

FOREIGN PATENT DOCUMENTS

| | | | | |
|---|---|---|---|---|
| JP | H0367949 | A | * | 3/1991 |
| JP | H064536 | U | * | 1/1994 |

OTHER PUBLICATIONS

Chelsey Bipat, Autoclaved Aerated Concrete: Overview and Applications, Sep. 16, 2019, Nearby Engineers, p. 1 and 3 https://www.ny-engineers.com/blog/autoclaved-aerated-concrete-overview-and-applications (Year: 2019).*
PCT Search Report and Written Opinion.

* cited by examiner

AIR VENT REGISTER WITH IMPROVED THERMAL RESISTANCE

CROSS-REFERENCE TO RELATED APPLICATIONS

The subject application claims priority to U.S. Provisional Patent Application No. 63/086,673 filed Oct. 2, 2020, the entire subject matter of which is hereby incorporated by reference.

TECHNICAL FIELD

The presently disclosed subject matter is generally directed to an air vent register for use with an HVAC system. More particularly, the disclosed vent register includes improved thermal resistance characteristics to reduce and/or prevent condensation from accumulating on the external surface of the register.

BACKGROUND

Most homes are equipped with a heating, ventilation, and air conditioning (HVAC) system for maintaining the air within the home at a set desired temperature. Conventional HVAC systems include manually adjustable register vents to control the amount of conditioned air introduced into a room. Supply vents typically include air cooled to temperatures ranging from about 40° F. to 60° F. When air cooled to such low temperatures is pumped into a warm and/or humid environment, moisture will condense on the HVAC vent register. This is especially problematic in humid environments, in homes with open areas (e.g., homes that include attics), and/or in areas of high moisture (e.g., bathrooms). As the cooled air is pumped into a room, moisture will condense on the vent register, causing undesirable water droplets to form. In addition to being unsightly, the water droplets can be messy, requiring frequent clean up and potentially staining carpet and/or paint. In addition, the water droplets can damage floors, carpets, and other items stored within range of the water droplet path. Over time, exposure to water can also rust metal. It would therefore be beneficial to provide a vent register that resists and/or prevents condensation and sweating observed when HVAC systems are used in warm or humid environments.

SUMMARY

In some embodiments, the presently disclosed subject matter is directed to a vent register comprising a housing configured for receiving airflow from a duct and directing the airflow toward an external location with respect to the duct. The housing is defined by a top plate, a bottom plate, and an interior compartment. The top plate is defined by a planar region and a raised ridge comprising a central opening. The bottom plate defined by a planar region and raised ridge comprising a central opening. The interior compartment is positioned between the planar region of the top plate and the planar region of the bottom plate. The top plate and bottom plates are aligned such that the top plate central opening and the bottom plate central opening form a housing central opening. The interior compartment is at least partially filled with ambient air, an insulative material, or combinations thereof.

In some embodiments, the interior compartment is hollow.

In some embodiments, the insulative material comprises foam.

In some embodiments, the top and bottom plates are formed as a single unit.

In some embodiments, the foam is selected from polyethylene foam, polyurethane foam, polystyrene foam, polyvinyl chloride foam, polypropylene foam, urethane foam, or combinations thereof.

In some embodiments, the interior compartment is about 20 percent filled (by volume) with an insulative material.

In some embodiments, the vent register further comprises a series of slats positioned within the central opening of the housing.

In some embodiments, at least one of the top plate or bottom plate comprises an opening in fluid communication with the interior compartment.

In some embodiments, the top plate and bottom plate are formed from thermally insulative materials.

In some embodiments, the thermally insulative materials comprise polypropylene homopolymer, propylene/ethylene copolymer, LDPE, HDPE, VLDPE, LLDPE, MDPE, polyester, polystyrene, polyamide homopolymer and/or copolymer, polycarbonate, cyclic olefin copolymer (COC), poly (lactic acid) (PLA), poly(glycolic acid) (PGA), poly(methyl methacrylate) (PMMA), thermoplastic polyurethane (TPU), or combinations thereof.

In some embodiments, the vent register comprises a thermal resistance of greater than about 30° K-mm$^2$/W.

In some embodiments, the presently disclosed subject matter is directed to an HVAC duct system. The duct system comprises at least one air duct for providing a passageway for forced conditioned air and a vent register configured for receiving airflow of the forced conditioned air from the air duct. The vent register comprises a housing defined by a top plate, a bottom plate, and an interior compartment positioned therebetween. The top plate is defined by a planar region and a raised ridge comprising a central opening. The bottom plate defined by a planar region and raised ridge comprising a central opening. The interior compartment positioned between the planar region of the top plate and the planar region of the bottom plate. The top plate and bottom plates are aligned such that the top plate central opening and the bottom plate central opening form a housing central opening. The interior compartment is at least partially filled with ambient air, an insulative material, or combinations thereof.

In some embodiments, the presently disclosed subject matter is directed to a method of directing air flow from an HVAC air duct through a vent register. The method comprises positioning the vent register on an HVAC air duct, and channeling forced air to pass from the HVAC air duct through the vent register, wherein no condensation forms on an exterior surface of the vent register as a result of the forced air passing through the vent register. The vent register comprises a top plate defined by a planar region and a raised ridge comprising a central opening. The vent register further comprises a bottom plate defined by a planar region and raised ridge comprising a central opening, and an interior compartment positioned between the planar region of the top plate and the planar region of the bottom plate. The top plate and bottom plates are aligned such that the top plate central opening and the bottom plate central opening form a housing central opening. The interior compartment is at least partially filled with ambient air, an insulative material, or combinations thereof.

DETAILED DESCRIPTION

Figure 1:
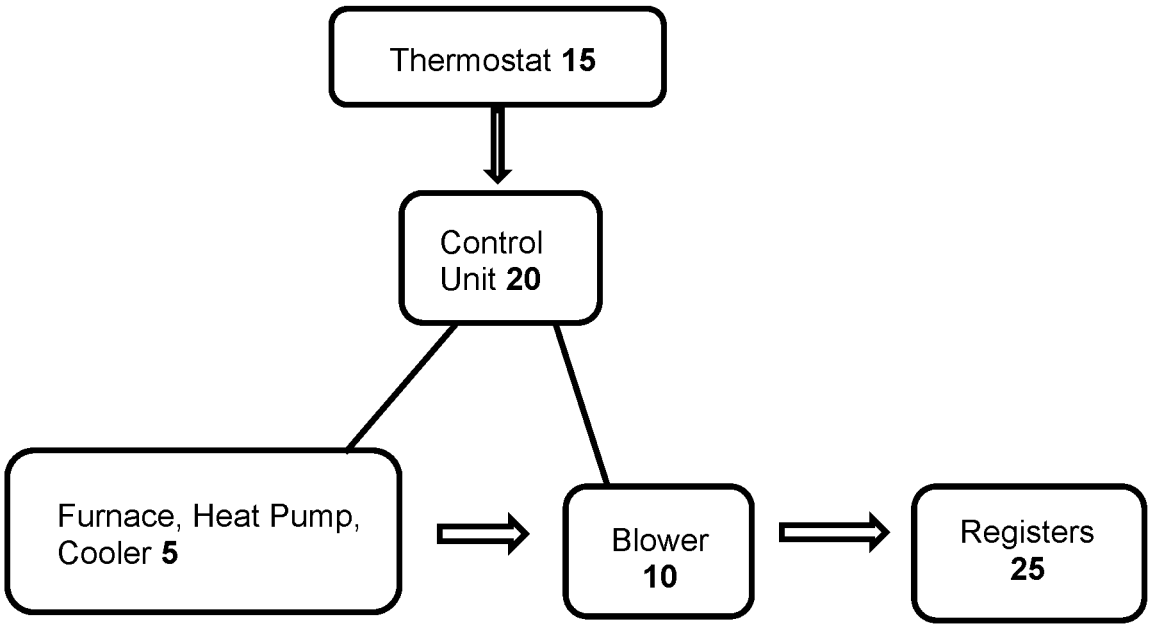
FIG. 1 is a flow chart illustrating a standard HVAC system flow in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to a vent register for use with an HVAC system to reduce and/or eliminate moisture issues common with conventional registers. The term "register" refers to any device that distributes airflow from an HVAC duct. FIG. 1 illustrates a conventional HVAC system configuration. As shown, a furnace, heat pump, cooler, and/or other device 5 cools or heats air. The air is then moved through the HVAC system by blower 10 coupled to the input or output of the heating/cooling device 5. A conventional thermostat 15 and control unit 20 regulate operation of the heating/cooling device 5 and blower 10. The conditioned (e.g., heated or cooled) air is carried by a series of ducts to a plurality of HVAC vents, such as supply registers 25. The supply registers can be disposed in various locations of a building, such as in walls of the rooms of a house, in walls or ceilings of an office building, etc. In some embodiments, at least one supply register is positioned in a given room. Each supply register can introduce conditioned air into its respective region. It should be appreciated that FIG. 1 is only one representative illustration of many possible configurations of HVAC systems.

Figure 2A:
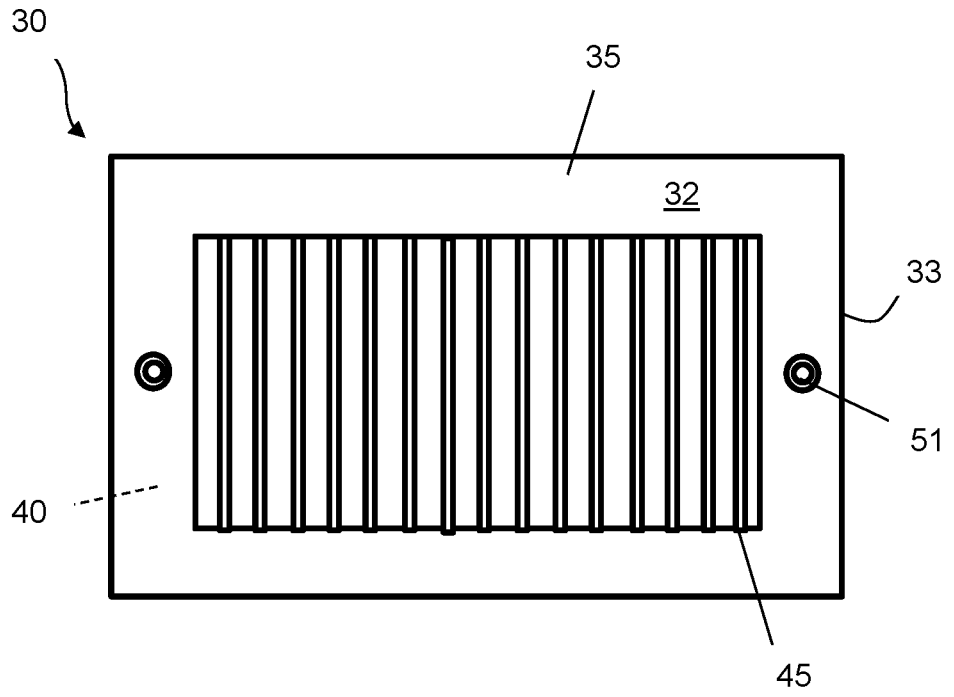
FIG. 2*a* is a top plan view of a vent register in accordance with some embodiments of the presently disclosed subject matter.
Figure 2B:
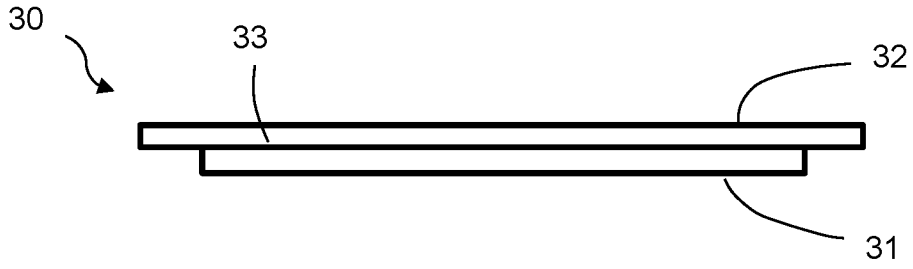
FIG. 2*b* is a side plan view of a vent register in accordance with some embodiments of the presently disclosed subject matter.

FIGS. 2*a* and 2*b* illustrate one embodiment of vent register 30 that can be used with the disclosed system. As shown, register 30 comprises housing 35 defined by bottom face 31, top face 32 and a periphery defined by side edges 33. In some embodiments, the side edges meet at substantially right angles to form four corners. However, the presently disclosed subject matter also includes embodiments where the side edges meet at greater or less than ninety-degree angles. The top face of housing 35 can rest adjacent to a portion of a support structure (such as a wall, floor, or the ceiling) that surrounds and defines an HVAC air duct or outlet when the register is inserted into the outlet. As described in more detail herein below, register 30 includes at least one interior compartment 40 that imparts an insulative quality to the register. The term "insulative" refers to the characteristic of having a resistance to an increase or decrease in temperature. In some embodiments, the interior compartment is hollow. In some embodiments, the interior compartment comprises insulative material, such as foam, air, or combinations thereof.

In some embodiments, the register can include a series of parallel slats 45 that are disposed between top and bottom faces 31, 32, as illustrated in FIG. 2*a*. The slats are spaced apart to generally allow the free passage of forced air through and between the slats to the external environment. The slats prevent items from being lost or stuck in the vent (e.g., jewelry, fingers, and the like).

Figure 2C:
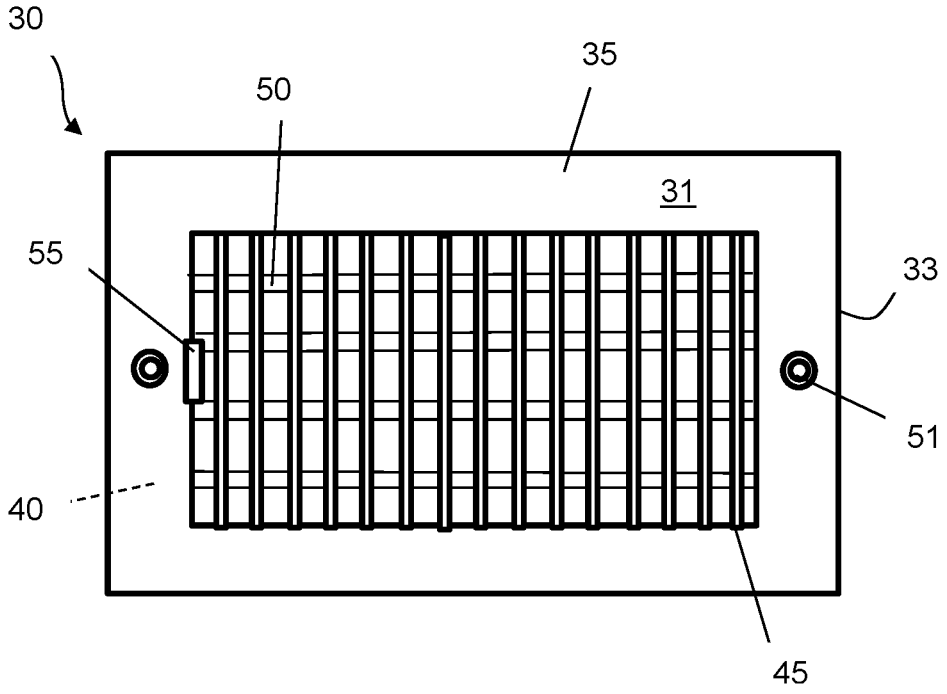
FIG. 2*c* is a top plan view of a vent register in accordance with some embodiments of the presently disclosed subject matter.

Optionally, the register can further include a plurality of vanes 50 that are disposed behind the parallel slats, as shown in FIG. 2*c*. The slats are typically fixed, while the vane members can be adjustable to alter the flow or amount of air that enters a space. Thus, the vane members can function as a controllable damper. The vanes can be effectuated by any type of functionally compatible hinge or pivot structure. For example, the vanes can be adjusted with actuator 55 to be either opened wider to allow greater air flow into the room or to be closed to restrict the flow of air into a room. The vane members are separated from the parallel slats to allow the movement of the vanes.

It should be appreciated that slats 35 and vanes 50 are optional. It should further be appreciated that the vanes and slats can have any desired configuration and are not limited to the embodiments shown in FIGS. 2*a* and 2*c*. For example, the vanes and/or slats can have a parallel, circular, floral, abstract, or other design.

The disclosed register can optionally include one or more apertures 51 that can be used to install the register on a corresponding surface (e.g., wall, ceiling). For example, the apertures can accommodate a pair of screws that engage the register to a duct flange (although any element can be used). The register can include any desired number of apertures positioned in any desired location on the housing of the register. Further, apertures 50 are optional and the disclosed register can be configured with no apertures.

Figure 3A:
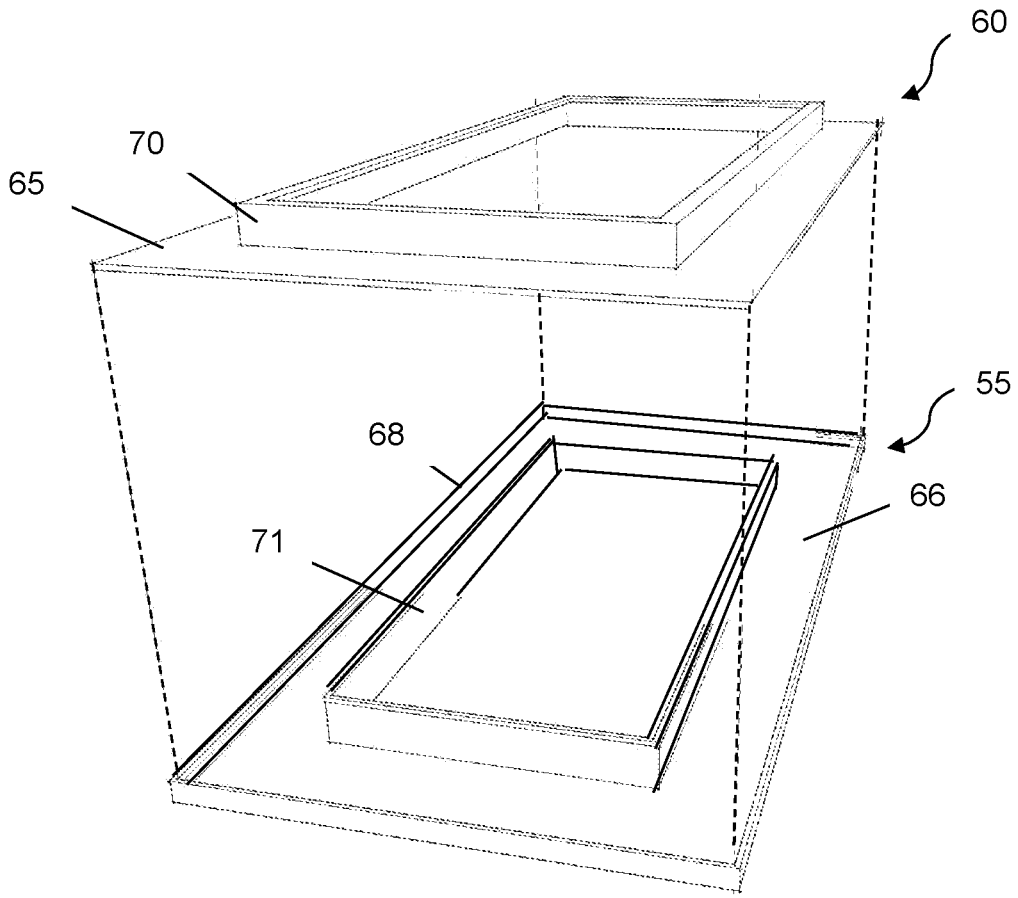
FIG. 3*a* is a perspective view illustrating top and bottom plates of a register in accordance with some embodiments of the presently disclosed subject matter.
Figure 3B:
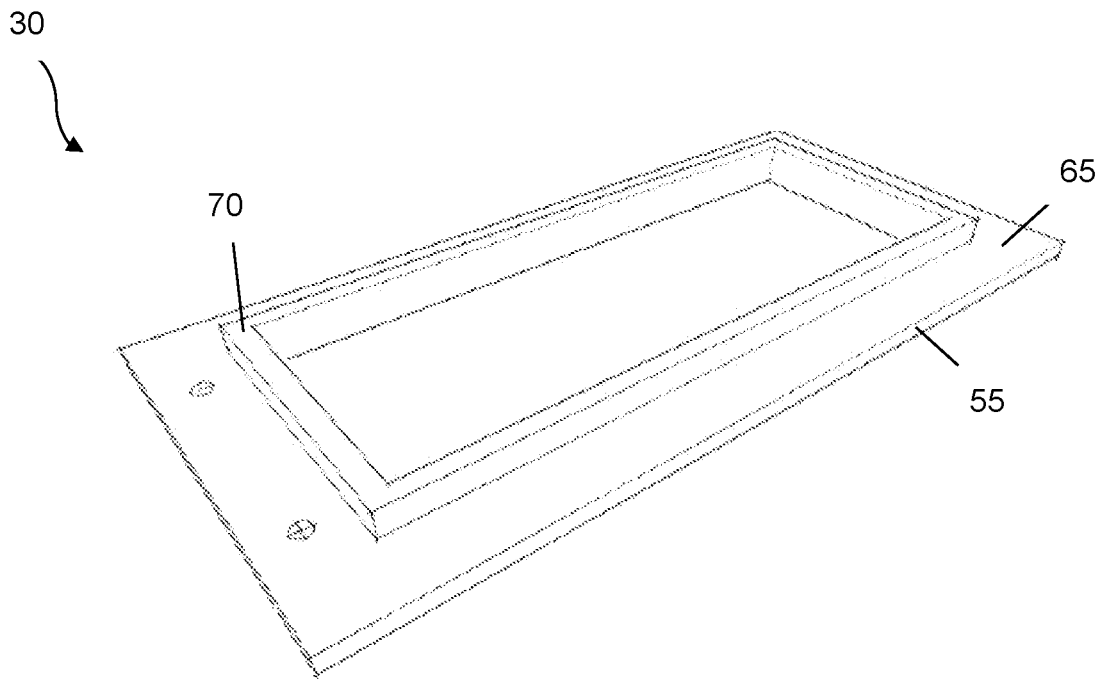
FIG. 3*b* is a perspective view of an assembled register in accordance with some embodiments of the presently disclosed subject matter.
Figure 3C:
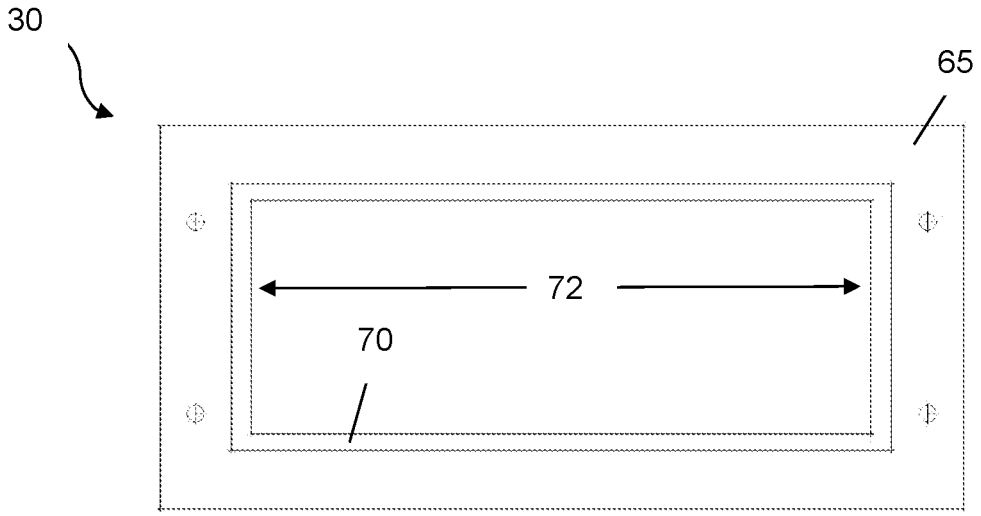
FIG. 3*c* is a top plan view of an assembled register in accordance with some embodiments of the presently disclosed subject matter.

Interior 40 of the disclosed vent register includes two layers with a sealed gap between the layers that provides heat resistance. The gap between the layers can vary from less than 1 inch to several inches in thickness. FIG. 3*a* illustrates one embodiment of bottom plate 55 and top plate 60 that are joined together to form the register housing 35. Top plate 60 includes planar region 65 that surrounds raised ridge 70. Likewise, bottom plate 55 comprises planar region 66 with lip 68 that surrounds raised ridge 71. The planar regions and raised ridges are sized and shaped to allow the top and bottom plates to overlay, forming register 30 as shown in FIGS. 3*b* and 3*c*. In some embodiments, raised ridge 70 is configured around the corresponding raised ridge 71 when the register is formed. In other embodiments, the reverse is true and the bottom plate raised ridge fits around the top plate raised ridge. In some embodiments, the raised ridge is sized and shaped to accommodate a plurality of register vanes and/or slats (not shown) within open area 72.

Top plate 60 and bottom plate 55 can be joined together using any known mechanism. For example, the plates can be permanently joined using adhesive, welding, heat sealing, and the like. Alternatively, the top and base plates can be releasably attached using a snap-fit closure, pressure-fit attachment, magnets, hook-and-loop closure, and/or the use of mechanical elements (e.g., screws, bolts, nails, clasps, fasteners). Any permanent or releasable mechanism can be used.

In other embodiments, the top and bottom plates are configured and/or constructed as a single unit (e.g., the top and bottom plates are not releasably attached together). Any suitable method can be used to construct the register. Thus, the top and bottom plates can refer to the top and bottom segments that are joined to form the register.

Figure 3D:
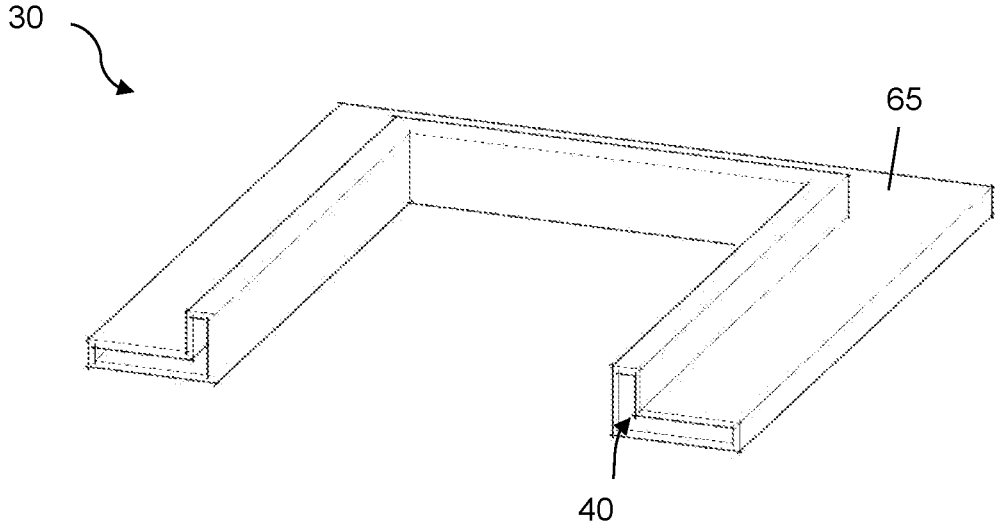
FIG. 3*d* is a cutaway view illustrating a register interior compartment in accordance with some embodiments of the presently disclosed subject matter.

Interior compartment 40 is formed between the top and bottom surfaces of the register, as shown in FIG. 3*d*. The interior compartment imparts thermal resistance characteristics to the register. Particularly, the interior compartment can be filled with air, fluid, solids, or combinations thereof. For example, the register interior compartment can be filled with ambient air in some embodiments. The ambient air housed within compartment 40 acts as a buffer between the cooled air exiting the HVAC vent and the ambient environment. However, the presently disclosed subject matter is not limited and interior compartment 40 can be filled with any desired gas, such as (but not limited to) carbon dioxide, nitrogen, oxygen, helium, or mixtures thereof.

In some embodiments, the register interior compartment can comprise one or more fluids. For example, the interior compartment can be at least partially filled with foam. The term "foam" refers to a material formed by trapping gas and/or air bubbles therein. Any foam can be used, such as (but not limited to) polyethylene foam, polyurethane foam, polystyrene foam, polyvinyl chloride foams, polypropylene foams, or combinations thereof. In some embodiments, the foam can be an expanding, foamed-in-place foam (e.g., urethane foam) that has the ability to fill interior compartment fully or partially.

However, it should be appreciated that the register interior compartment 40 can include any desired fluid and is not limited to foam materials. Therefore, any suitable fluid can be used, such as (but not limited to) water, buffer, Aerogel®, glycol, PEG, and the like. In such embodiments, compartment 40 is fluid-sealable and does not leak.

Figure 4:
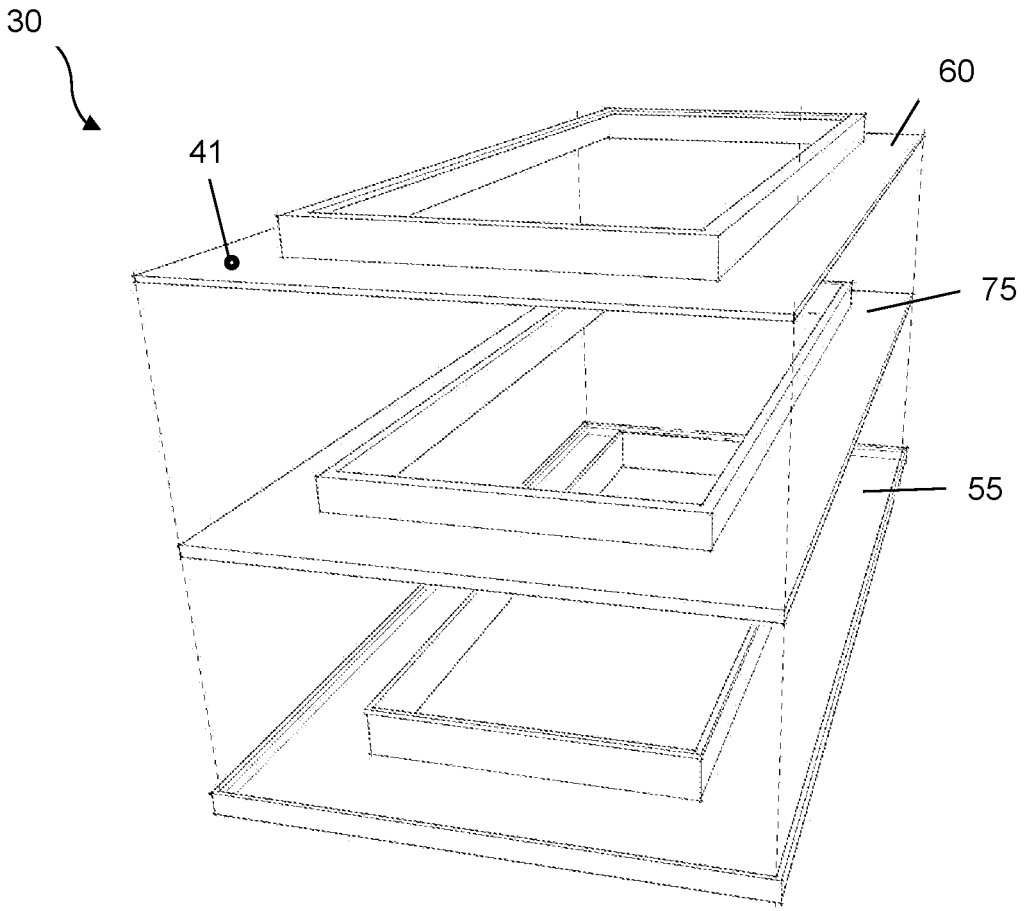
FIG. 4 is a perspective view illustrating a register comprising an interior insulative plate in accordance with some embodiments of the presently disclosed subject matter.

In some embodiments, interior compartment 40 can house one or more solid materials, such as Styrofoam boards, blankets, or sheets. Particularly, FIG. 4 illustrates insulation sheet 75 housed between top and bottom plates 55, 60. In some embodiments, sheet 75 can be sized and shaped to mimic the shape of the interior compartment and/or the raised ridge. However, sheet 75 can have any desired size and shape so long as it can be housed within compartment 40. Sheet 75 can be sized to match the interior surface of compartment 40. The sheet can be positioned within the interior compartment with or without the use of adhesive or any other fixative element, allowing the register to be quickly assembled or manufactured as needed.

The presently disclosed subject matter is not limited to solids configured in sheet form. For example, particulates (e.g., pellets or smaller units) of insulative materials can be distributed within the interior compartment.

Solid insulative materials can include (but are not limited to) solid foams, cloth, wood chips, rubber, sand, silicone, and the like. Any solid material that resists a change in temperature can be used.

The top and/or bottom plate can include one or more openings 41 that pass through the plate, allowing a material (e.g., foam) to be added to the interior compartment, as shown in FIG. 4. After the material has been added to the register interior, the aperture can be closed using conventional methods.

In some embodiments, interior compartment 40 can be filled to about 5-100 percent of the interior volume of the register. Thus, the interior compartment can be filled to at least about (or no more than about) 5, 10, 15, 20, 25, 30, 35, 40, 45, 50, 55, 60, 65, 70, 75, 80, 85, 90, 95, or 100 percent of the total volume of the compartment.

The top and bottom plates of the register can be constructed from any desired rigid or semi-rigid material. The term "rigid material" refers to a material that does not break or bend under pressure. The term "semi-rigid material" refers to a material that resists breaking or bending under pressure but allows more bending when compared to a rigid material. Suitable materials can therefore include (but are not limited to) one or more polymeric materials, metal, rubber, elastomer, wood, composite material, ceramics, or combinations thereof.

Suitable polymeric materials can include (but are not limited to) at least one polyolefin (polypropylene homopolymer, propylene/ethylene copolymer, LDPE, HDPE, VLDPE, LLDPE, MDPE), polyester (e.g., PET and PETG), polystyrene, (e.g., modified styrenic polymer such as SEBS, SBS, etc.), polyamide homopolymer and/or copolymer (e.g., PA6, PA12, PA6/12, etc.), polycarbonate, cyclic olefin copolymer (COC), poly(lactic acid) (PLA), poly(glycolic acid) (PGA), poly(methyl methacrylate) (PMMA), thermoplastic polyurethane (TPU), or combinations thereof. It should be appreciated that any polymeric material can be used.

Suitable metals can include (but are not limited to) stainless steel, aluminum, copper, and the like. In some embodiments, the metal can be coated to further enhance the thermally insulative characteristics of the register (e.g., galvanized steel).

Any of the materials used to construct register 30 can optionally include one or more additives. Suitable additives can include (but are not limited to) pigments, UV stabilizers, UV absorbers, antioxidants, flame retardants, layered silicates, fillers, colorants, reinforcing agents, impact strength modifiers, antimicrobials, or combinations thereof.

In some embodiments, the material(s) used to construct the disclosed register have thermally resistive properties (e.g., can resist changes in temperature). In some embodiments, the thermal conductivity of a material can be tested using ASTM E1225-04, the entire content of which is incorporated by reference herein. Thus, in some embodiments, the materials used to construct the register can have a high thermal resistance value. The term "thermal resistance" refers to the temperature difference at a steady state between two defined surfaces of a material that induces a unit heat flow rate through a unit area. Thus, the register (or some/all of the materials used to construct the register) can have a high thermal resistance value of greater than about 30-200° K-mm$^2$/W (e.g., at least/no more than about 50, 60, 70, 80, 90, 100, 125, 150, 175, or 200° K-mm$^2$/W). The thermal resistance can be measured using conventional techniques, such as with a DynTIM-S instrument available from Siemens (Munich, Germany), a TIMA instrument from NanoTest (Germany), and/or a LongWin LW 9389 (Taiwan).

Although depicted as rectangular in the figures, register 30 can be constructed in any functionally compatible size and/or shape. For example, the register can be constructed to be rectangular, square, circular, oval, triangular, hexagonal, pentagonal, octagonal, abstract, and the like. In some embodiments, the register can include predetermined sizes and shapes to engage corresponding standard HVAC ducts as are known in the art.

The disclosed register can have any desired size. For example, in some embodiments, the register can have a length and/or width of about 5-20 inches (e.g., at least/no more than about 5, 6, 7, 8, 9, 10, 11, 12, 13, 14, 15, 16, 17, 18, 19, or 20 inches). Similarly, register 30 can have any desired thickness, such as about 0.1-2 inches (e.g., at least/no more than about 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, or 2 inches). However, the presently disclosed subject matter is not limited and can be constructed with a length, width, and/or thickness outside the ranges given above.

Figure 5:
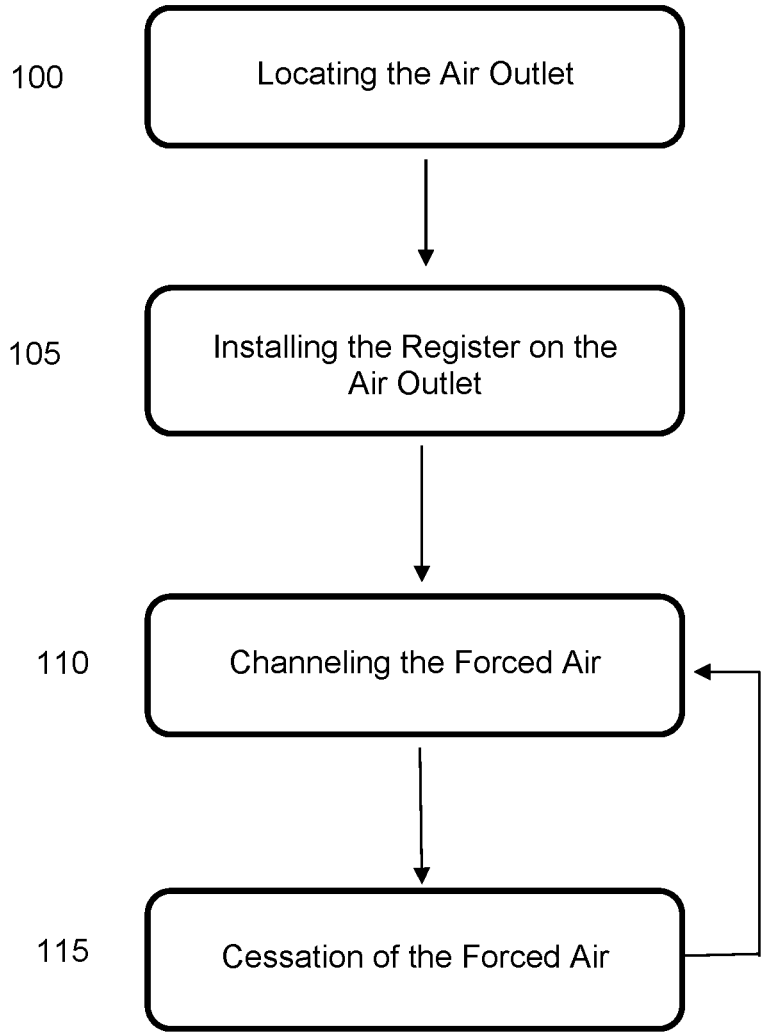
FIG. 5 is a flow chart illustrating one method of using the disclosed system.

FIG. 5 illustrates a schematic of one method of using the disclosed register. As shown, an HVAC air vent outlet is located at step 100. An operator can then select a desired register 30 based on size and shape to fit the desired vent. The operator can then fit the register to the selected air outlet. For example, if the outlet is located on the floor, gravity can generally hold the register in place. Alternatively, fasteners such as screws and the like can be used to install the register at a desired location (e.g., a ceiling in a room). The register can be specifically sized and shaped for standard floor or ceiling vent openings.

Register 30 can be installed in a new HVAC system or can easily be retrofitted into an existing structure, as indicated at step 105. When the HVAC system generates forced air, it passes from the blower passage through a corresponding vent, passing through the register slats out to the surrounding environment.

The HVAC system can then be placed in operative mode to generate forced air such that cooled or heated air flows through the system and exits a vent through register 30, at steps 110-115. The insulative characteristics of the vent function to reduce and/or prevent the incidence of condensation forming on the vent as cooled air flows through the register. Specifically, interior compartment 40 and/or the materials used to construct the register operate to mitigate heat transfer between the ambient environment and the cooled air blowing out of the register. The cooled air is separated from the exterior surface of the register and prevents the register from being cooled to any substantial extent so that moisture from the associated room does not condense on the register. In some embodiments, a 100% reduction in condensation is observed compared to convention registers. In other embodiments, a 50-99 percent reduction in the formation of condensation is observed on the register.

The disclosed register therefore provides favorable thermal and insulative qualities with an advantageous ability to maintain a cool or warm temperature environment for an extended period of time due at least in part to the interior compartment 40. The materials used to construct the vent register can also contribute to the thermal resistance.

Register 30 offers many improvements over prior art HVAC registers. For example, the heat insulative properties of the disclosed register reduce or prevent condensation from forming when cooled air is pumped into a room.

Register 30 also provides a pleasing appearance to the HVAC register, without unsightly water droplets.

Use of the disclosed register prevents damage to surrounding property that commonly results from moisture drips and drops.

The disclosed register can be economically manufactured, allowing for widespread use.

In addition, register 30 is capable of maintaining a desired limited temperature range for an extended period of time.

Register 30 can include double walled construction to provide increased thermal resistance. The term "double walled" refers to a particular geometry wherein the inner and outer walls are spaced apart to form an interior compartment that can be at least partially filled with air or insulative material.

The register is independent in installation and is a solid one-piece formed unit. The register will not restrict airflow.

The disclosed register is easily removeable and reusable in a variety of ducts in an HVAC system.

Because it is not in constant or near-constant contact with moisture, the life of register 30 is extended over prior art HVAC registers.

The foregoing descriptions have been presented for purposes of illustration and description and are not intended to be exhaustive or to limit the presently disclosed subject matter. Many modifications and variations are possible in light of the present disclosure.

What is claimed is:

1. A vent register comprising:

a housing configured for receiving airflow from a duct and directing the airflow toward an external location with respect to the duct, wherein the housing is defined by:

a top plate and a bottom plate joined together with the top plate above the bottom plate to form an interior compartment therebetween;

four side edges;

wherein the top plate is defined by a planar region and a central raised ridge extending upward from the planar region and away from the bottom plate, wherein a central opening is positioned through the planar region and the central raised ridge and wherein the planar region extends around an entire outer perimeter of the central raised ridge;

wherein the bottom plate is defined by a planar region comprising a raised ridge extending in an upward direction towards the top plate, wherein a central opening passes through the planar region and the central raised ridge, and wherein the bottom plate comprises a lip extending in an upward direction towards the top plate and extending around the four side edges;

wherein the interior compartment is positioned between the planar region of the top plate and the planar region of the bottom plate;

wherein the top plate and bottom plates are aligned and joined together such that the top plate central opening and the bottom plate central opening are aligned to form a housing central opening and wherein the top plate planar region contacts the bottom plate lip to form the interior compartment; and wherein the interior compartment is at least partially filled with ambient air, an insulative material, or combinations thereof.

2. The vent register of claim 1, wherein the interior compartment is hollow.

3. The vent register of claim 1, wherein the insulative material comprises foam, consisting of polyethylene foam, polyurethane foam, polystyrene foam, polyvinyl chloride foam, polypropylene foam, urethane foam, or combinations thereof.

4. The vent register of claim 1, wherein the interior compartment is about 20 percent filled by volume with an insulative material.

5. The vent register of claim 1, further comprising a series of slats positioned within the central opening of the housing.

6. The vent register of claim 1, wherein at least one of the top plate or bottom plate comprises an opening in fluid communication with the interior compartment.

7. The vent register of claim 1, wherein the top plate and bottom plate are formed from thermally insulative materials consisting of polypropylene homopolymer, propylene/ethylene copolymer, LDPE, HDPE, VLDPE, LLDPE, MDPE, polyester, polystyrene, polyamide homopolymer and/or copolymer, polycarbonate, cyclic olefin copolymer (COC), poly(lactic acid) (PLA), poly(glycolic acid) (PGA), poly (methyl methacrylate) (PMMA), thermoplastic polyurethane (TPU), or combinations thereof.

8. The vent register of claim 1, comprising a thermal resistance of greater than about 30° K-mm$^2$/W.

9. The vent register of claim 1, wherein the top and bottom plates are formed as a single unit.

10. An HVAC duct system comprising:

at least one air duct for providing a passageway for forced conditioned air; and a vent register configured for receiving airflow of the forced conditioned air from the air duct, the vent register comprising:

a housing defined by:

a top plate and a bottom plate joined together with the top plate above the bottom plate to form an interior compartment therebetween;

four side edges;

wherein the top plate is defined by a planar region and a central raised ridge extending upward from the planar region and away from the bottom plate, wherein a central opening is positioned through the planar region and the central raised ridge and wherein the planar region extends around an entire outer perimeter of the central raised ridge;

wherein the bottom plate is defined by a planar region comprising a raised ridge extending in an upward direction towards the top plate, wherein a central opening passes through the planar region and the central raised ridge, and wherein the bottom plate comprises a lip extending in an upward direction towards the top plate and extending around the four side edges;

wherein the interior compartment is positioned between the planar region of the top plate and the planar region of the bottom plate;

wherein the top plate and bottom plates are aligned and joined together such that the top plate central opening and the bottom plate central opening are aligned to form a housing central opening and wherein the top plate planar region contacts the bottom plate lip to form the interior compartment; and wherein the interior compartment is at least partially filled with ambient air, an insulative material, or combinations thereof.

11. The HVAC duct system of claim 10, wherein the vent register comprises a thermal resistance of greater than about 30° K-mm$^2$/W.

12. A method of directing air flow from an HVAC air duct through a vent register, the method comprising:

positioning the vent register on an HVAC air duct, wherein the vent register comprises:

a top plate and a bottom plate joined together with the top plate above the bottom plate to form an interior compartment therebetween;

four side edges;

wherein the top plate is defined by a planar region and a central raised ridge extending upward from the planar region and away from the bottom plate, wherein a central opening is positioned through the planar region and the central raised ridge and wherein the planar region extends around an entire outer perimeter of the central raised ridge;

wherein the bottom plate is defined by a planar region comprising a raised ridge extending in an upward direction towards the top plate, wherein a central opening passes through the planar region and the central raised ridge, and wherein the bottom plate comprises a lip extending in an upward direction towards the top plate and extending around the four side edges;

wherein the interior compartment is positioned between the planar region of the top plate and the planar region of the bottom plate;

wherein the top plate and bottom plates are aligned and joined together such that the top plate central opening and the bottom plate central opening are aligned to form a housing central opening and wherein the top plate planar region contacts the bottom plate lip to form the interior compartment; and wherein the interior compartment is at least partially filled with ambient air, an insulative material, or combinations thereof;

channeling forced air to pass from the HVAC air duct through the vent register;

wherein no condensation forms on an exterior surface of the vent register as a result of the forced air passing through the vent register.

13. The method of claim 12, wherein the insulative material comprises foam consisting of polyethylene foam, polyurethane foam, polystyrene foam, polyvinyl chloride foam, polypropylene foam, urethane foam, or combinations thereof.

14. The method of claim 12, wherein the interior compartment is about 20 percent filled by volume with an insulative material.

15. The method of claim 12, wherein at least one of the top plate or bottom plate comprises an opening in fluid communication with the interior compartment.

16. The method of claim 12, wherein the top plate and bottom plate are formed from thermally insulative materials.

17. The method of claim 16, wherein the thermally insulative materials consist of polypropylene homopolymer, propylene/ethylene copolymer, LDPE, HDPE, VLDPE, LLDPE, MDPE, polyester, polystyrene, polyamide homopolymer and/or copolymer, polycarbonate, cyclic olefin copolymer (COC), poly(lactic acid) (PLA), poly(glycolic acid) (PGA), poly(methyl methacrylate) (PMMA), thermoplastic polyurethane (TPU), or combinations thereof.

18. The method of claim 12, wherein the vent register comprises a thermal resistance of greater than about 30° K-mm$^2$/W.

19. The vent register of claim 1, wherein the top plate central raised ridge is configured around the bottom plate raised ridge.

20. The vent register of claim 1, wherein the bottom plate raised ridge is configured around the top plate central raised ridge.

21. The vent register of claim 1, further comprising a foam insulation sheet housed within the top and bottom plates, the foam insulation sheet comprising a planar region and a central raised ridge extending upward from the planar region and away from the bottom plate.

* * * * *